US006196983B1

(12) United States Patent
Wu

(10) Patent No.: US 6,196,983 B1
(45) Date of Patent: Mar. 6, 2001

(54) AUXILIARY DEVICE FASTENED WITH A BACK MASSAGING CHAIR FOR ENHANCING MASSAGING EFFECT

(76) Inventor: Dong-Her Wu, P.O. Box 23-487, Changhua City 500 (TW)

( * ) Notice: Subject to any disclaimer, the term of this patent is extended or adjusted under 35 U.S.C. 154(b) by 0 days.

(21) Appl. No.: 09/316,392

(22) Filed: May 21, 1999

(30) Foreign Application Priority Data

Dec. 31, 1998 (TW) ..... 87221930

(51) Int. Cl.[7] ..... A61H 15/00

(52) U.S. Cl. ..... 601/99; 601/102; 601/103; 601/116

(58) Field of Search ..... 601/49–53, 97, 601/98, 99, 100–103, 115, 116, 122, 126, 84, 90–95

(56) References Cited

U.S. PATENT DOCUMENTS 3,322,116 * 5/1967 Murphy et al. ..... 601/99
4,718,408 * 1/1988 Barreiro ..... 601/99
5,179,940 * 1/1993 Barreiro ..... 601/99
5,460,598 * 10/1995 Yamasaki et al. ..... 601/98
5,464,382 * 11/1995 Wang ..... 601/99
5,755,677 * 5/1998 Masuda et al. ..... 601/99
5,807,288 * 9/1998 Wu ..... 601/102
6,039,705 * 3/2000 Wu ..... 601/99

* cited by examiner

*Primary Examiner*—Justine R. Yu

(57) ABSTRACT

An auxiliary device is used in conjunction with a back massaging device and is composed of a base, a movable seat, a plurality of crank axles, a plurality of roller sets, and a transmission apparatus. The base is provided with a plurality of compression springs to enable the movable seat, the crank axles, and the roller sets to swivel in all directions so as to bring about an effective rubbing of the curved portions of the back of a person. The movable seat is provided with an arcuate slot to prevent the vertebrate of the person from making contact with the movable seat.

1 Claim, 13 Drawing Sheets

AUXILIARY DEVICE FASTENED WITH A BACK MASSAGING CHAIR FOR ENHANCING MASSAGING EFFECT

FIELD OF THE INVENTION

The present invention relates generally to a means for massaging the back of a person, and more particularly to a device that is fastened with a back massaging chair for enhancing the massaging effect of the back massaging chair.

1. Background of the Invention

The conventional back-massaging devices are generally provided with a plurality of rollers or knobs to bring about the massaging effect. These rollers or knobs are in fact ineffective in rubbing the back of a person, especially the curved portions of the back. In addition, the rubbing of the back by the rollers or knobs of the conventional back-massaging devices often results in a back pain.

2. Summary of the Invention

The primary objective of the present invention is therefore to provide an auxiliary device capable of eliminating the drawbacks of the conventional back-massaging devices described above.

It is another objective of the present invention to provide an auxiliary device capable of enhancing the rubbing effect of a back-massaging means.

In keeping with the principle of the present invention, the foregoing objectives of the present invention are attained by an auxiliary device comprising a base, a movable seat, two or more crank axles, a plurality of massaging rollers, and a transmission apparatus. The base is provided with a plurality of compression springs to enable the movable seat, the crank axles, and the rollers to swivel in all directions, thereby bringing about an effective rubbing of the curved portions of a person's back. The movable seat is provided with an arcuate slot to prevent the person's vertebrae from making contact with device.

The foregoing objectives, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
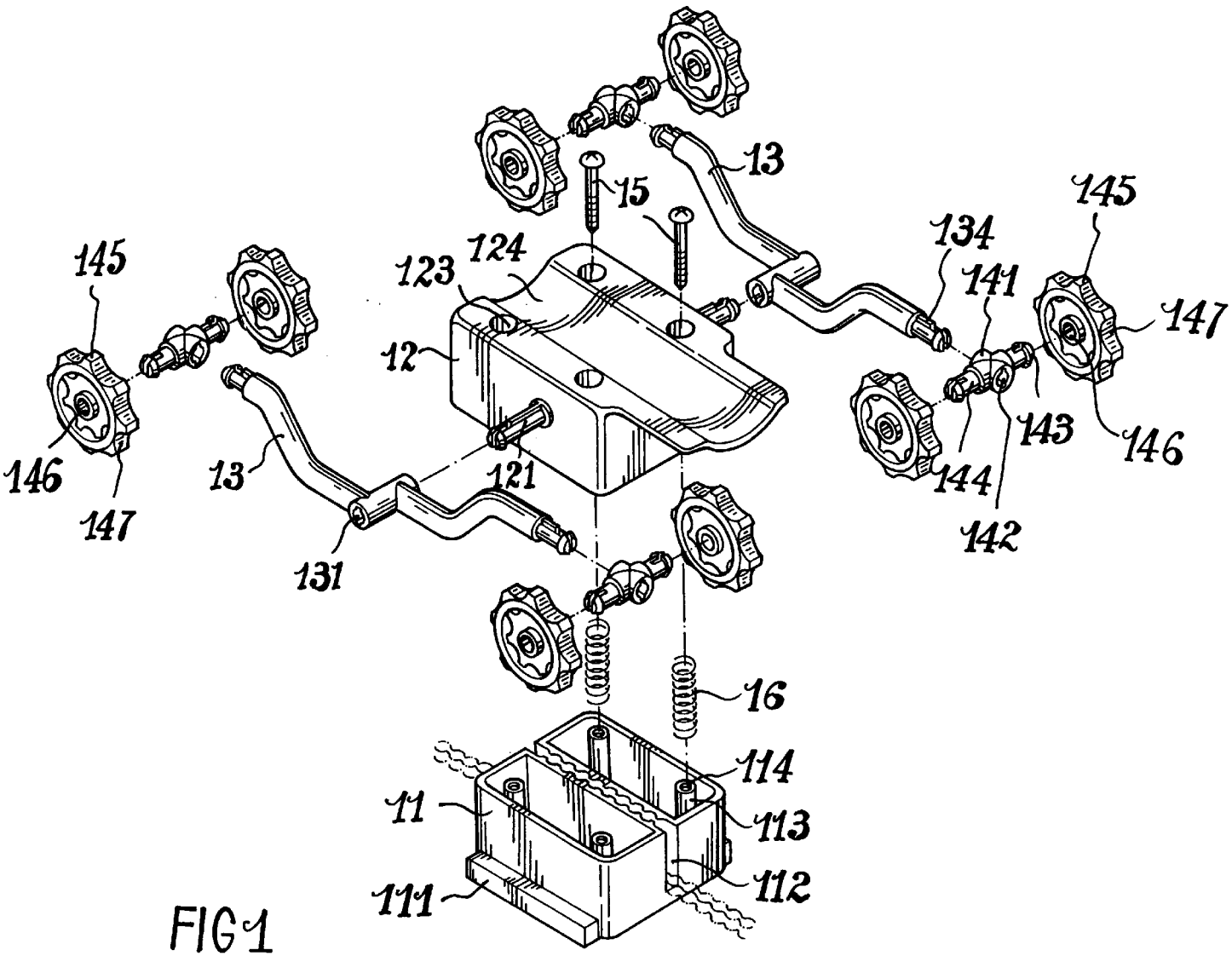
FIG. 1 shows a partial exploded view of a first embodiment of auxiliary device of the invention.
Figure 2:
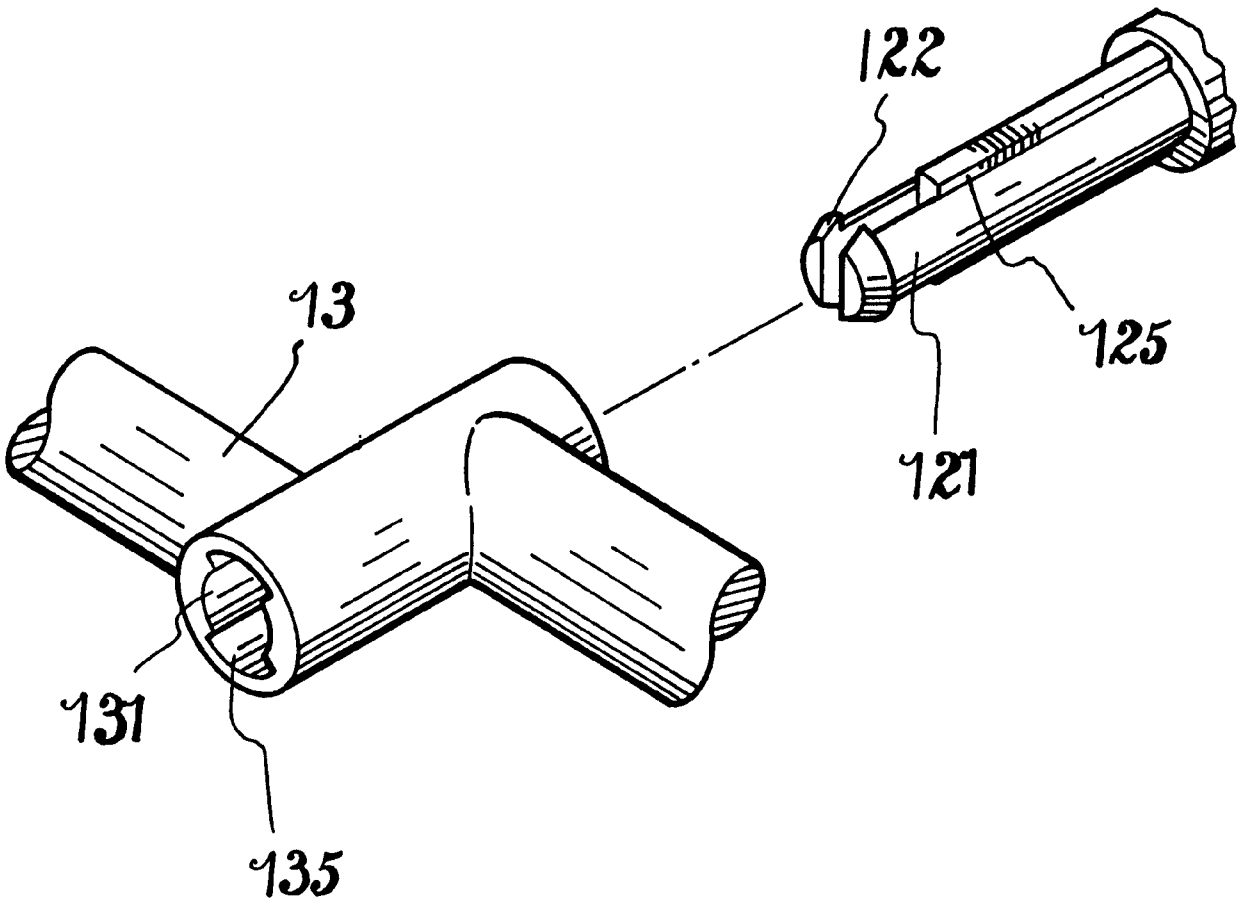
FIG. 2 is a perspective view showing the locating shaft disengaged from the through hole of crank axle.
Figure 3:
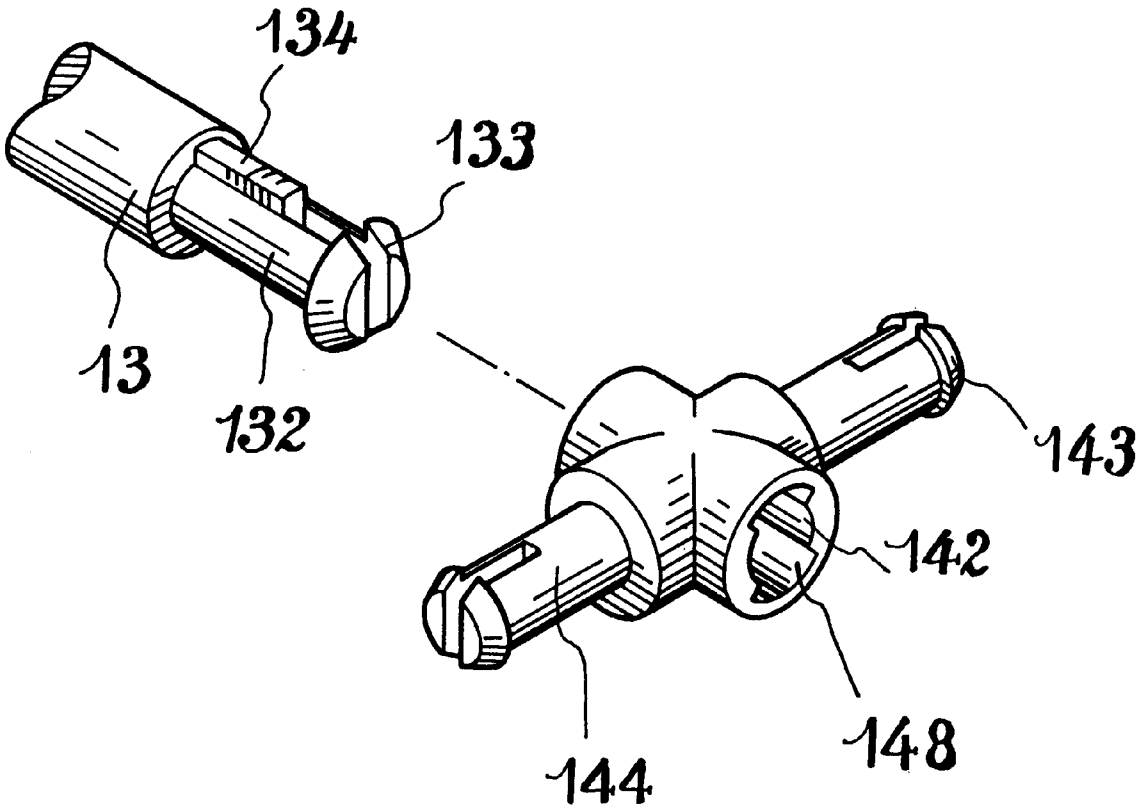
FIG. 3 is a perspective view showing the locating portion of crank axle disengaged from the through hole of roller set.
Figure 4:
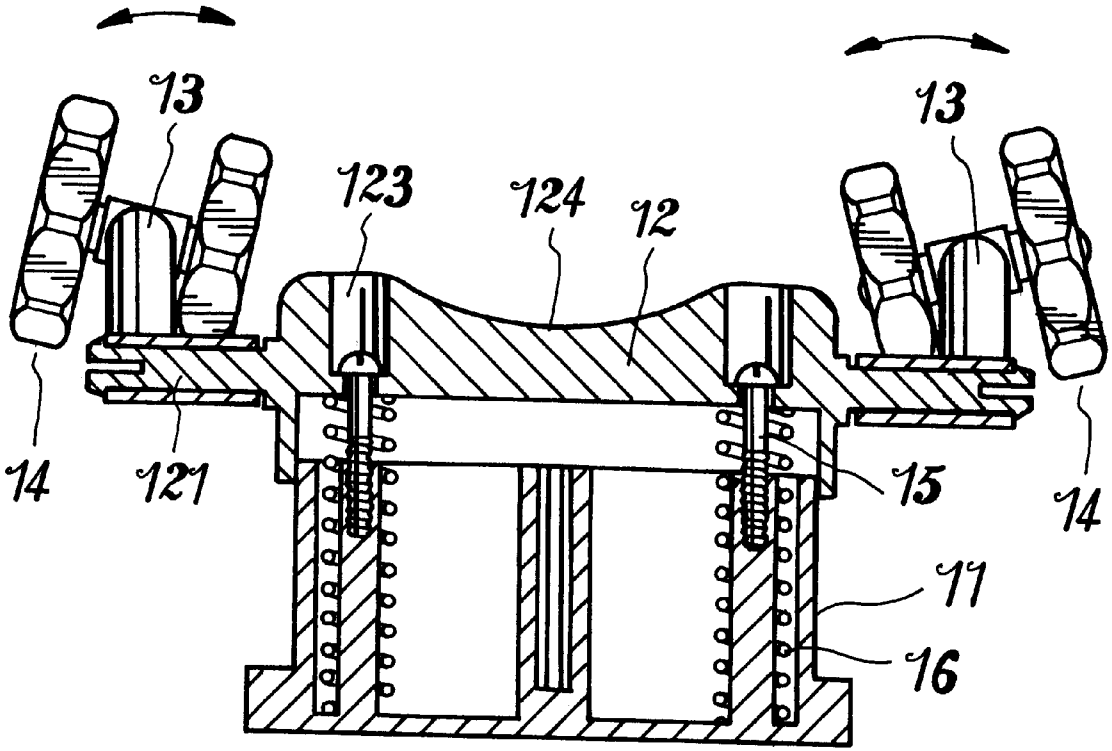
FIG. 4 is a partial cross-sectional view of the assembled auxiliary device of FIG. 1, where roller sets swinging to-and-fro in the lateral direction.
Figure 5:
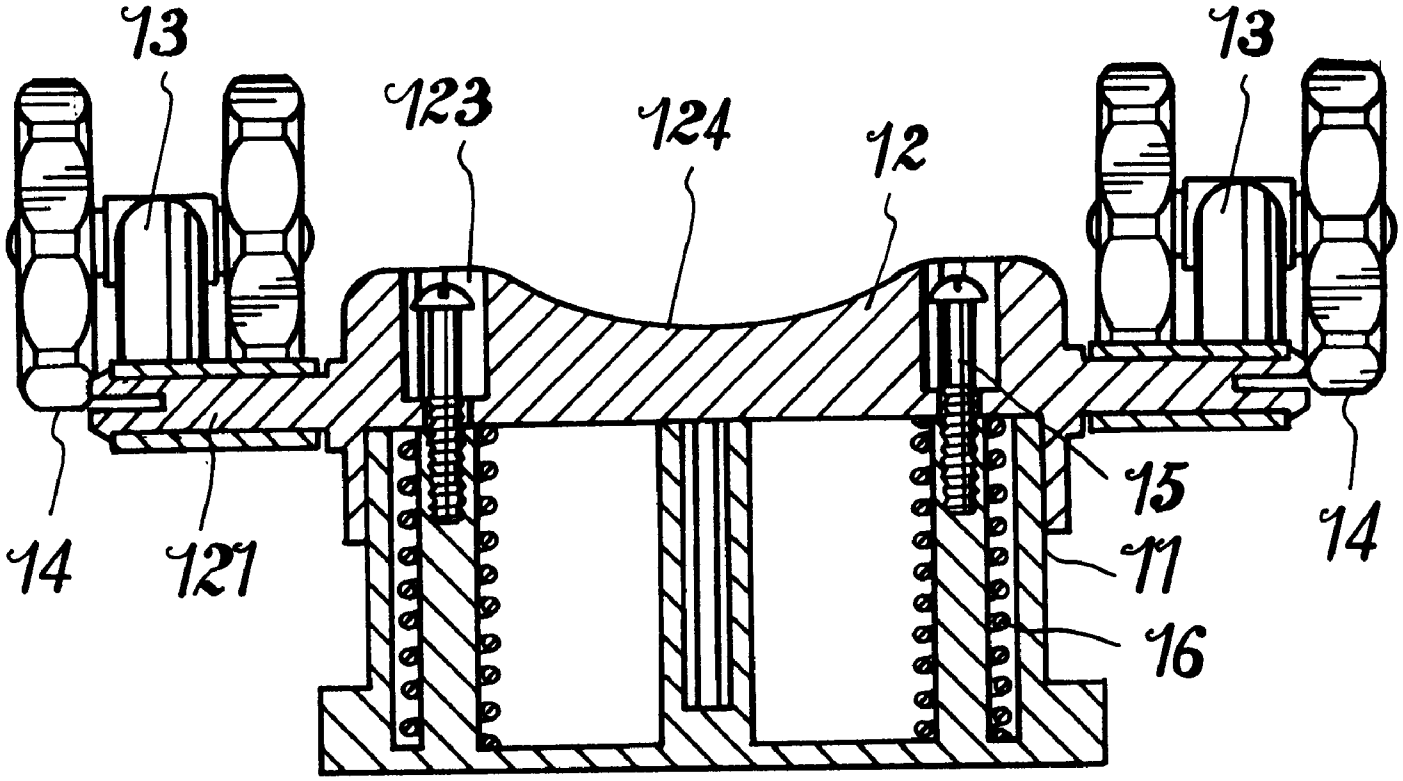
FIG. 5 is similar to FIG. 4, where roller sets in an inoperable position.
Figure 6:
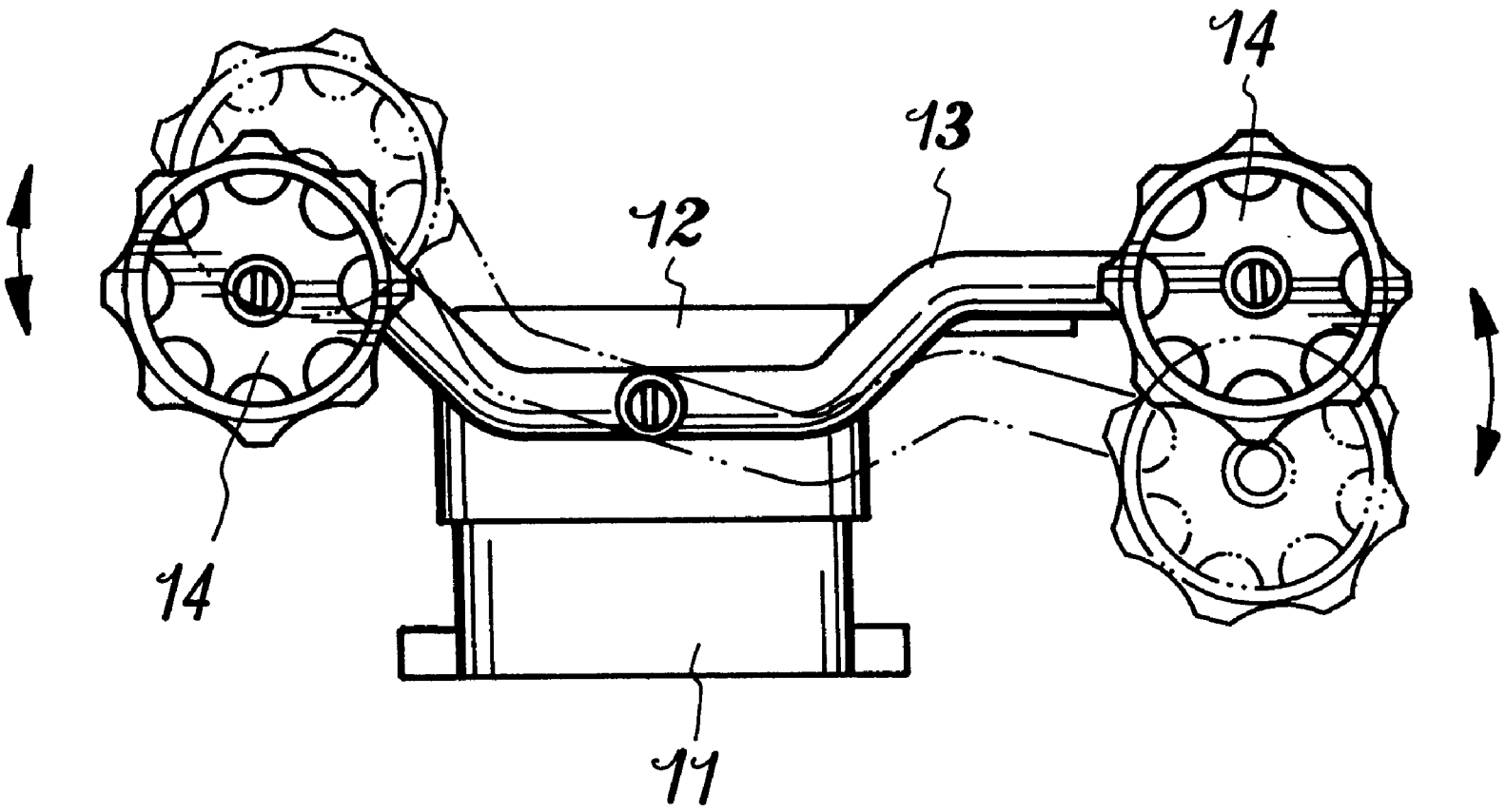
FIG. 6 is a side view schematically illustrating the up-and down motion of roller sets.
Figure 7:
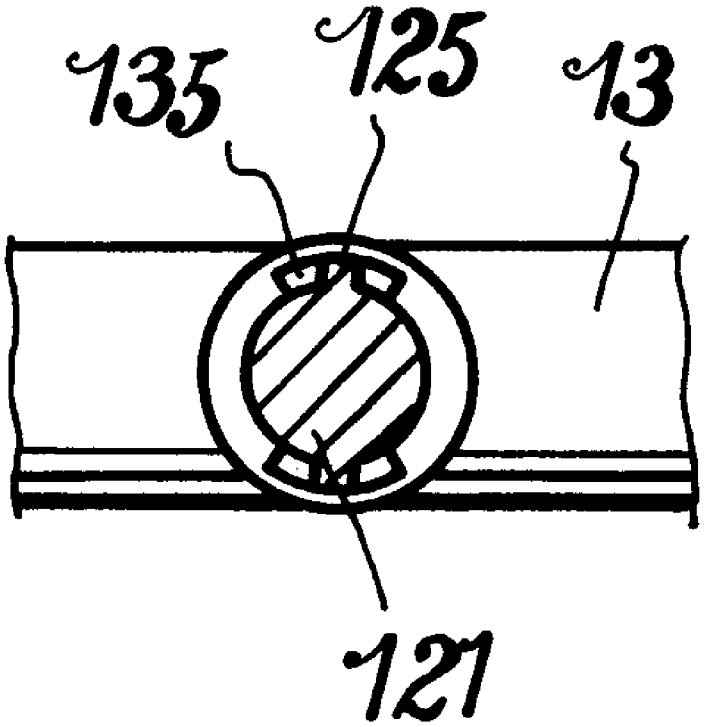
FIG. 7 is side view in part section showing the engagement of locating shaft and the through hole of crank axle of FIG. 2.
Figure 8:
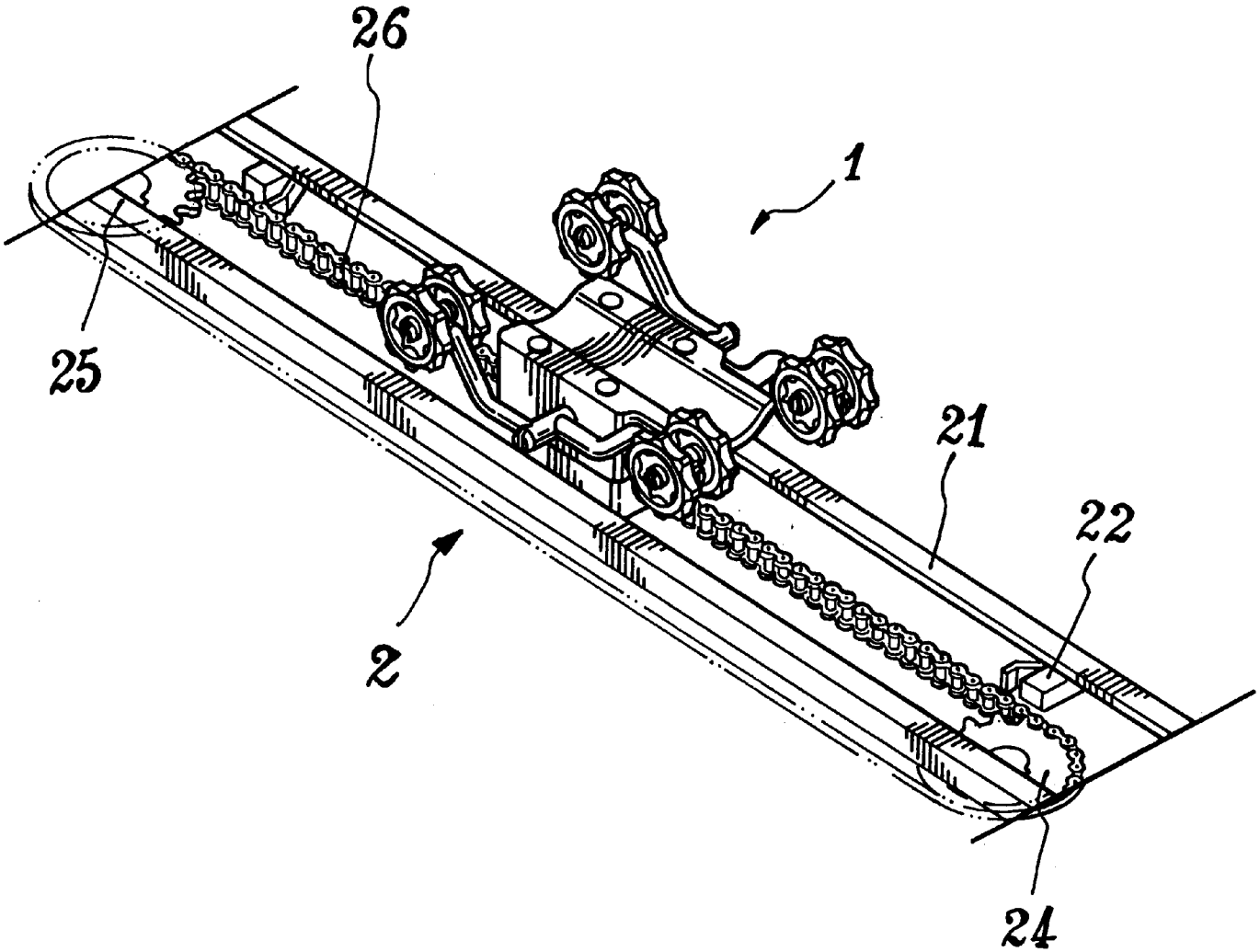
FIG. 8 is a perspective view of the assembled auxiliary device of FIG. 1 mounted on the transmission apparatus.
Figure 9:
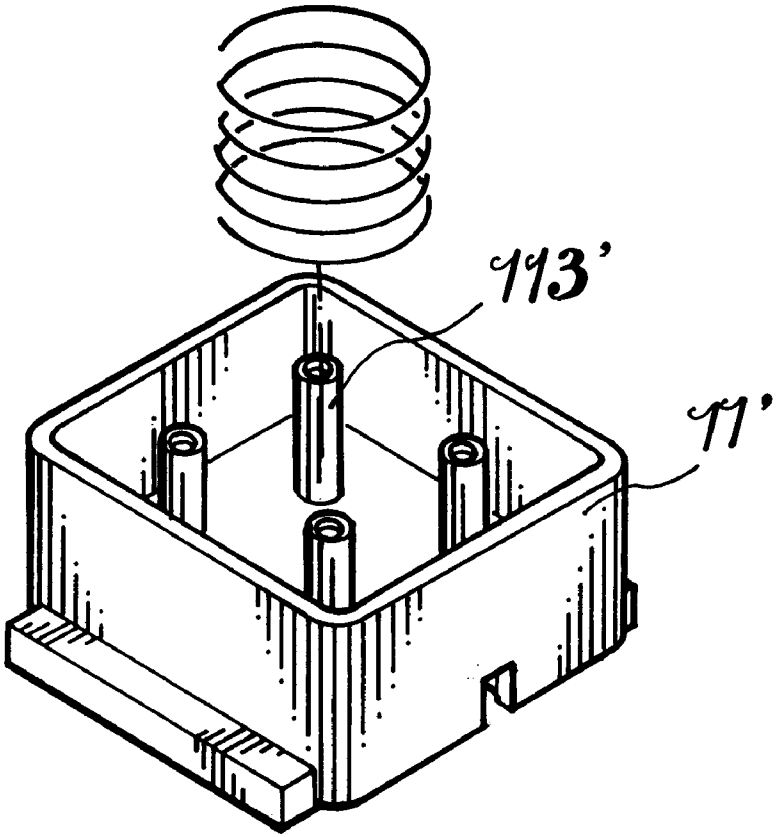
FIG. 9 is a perspective view of base equipped with a large compression spring and a groove provided in the bottom of base in a second embodiment, where compression spring disengaged from base.

As shown in FIGS. 1–8, an auxiliary device 1 embodied in the present invention is intended for use in conjunction with a back massaging machine and is composed of a base 11, a movable seat 12, two or more crank axles 13, a plurality of roller seats 14, and a transmission apparatus 2 (FIG. 8).

The base 11 is provided with two slide blocks 111, a groove 112, four locating shafts 113 each having a threaded hole 114 and a plurality compression spring 16 fitted thereover.

The movable seat 12 is provided with two locating shafts 121 each having a retaining block 122 and two stop blocks 125. The movable seat 12 is further provided with four round holes 123 corresponding in location to the four locating shafts 113 of the base 11, and an arcuate slot 124. The movable seat 12 is fastened with the base 11 such that the four locating shafts 113 of the base 11 are received in the four round holes 123 of the movable seat 12, and that four fastening bolts 15 are respectively engaged with the four threaded holes 114 of the four locating shafts 113 of the base 11.

The crank axles 13 are provided with a through hole 131 which is provided with two stop slots 135 opposite in location to each other. The crank axles 13 are mounted on the locating shafts 121 which are received in the through holes 131 of the crank axles 13. A locating portion 132 is formed at either end of the crank axle 13 having a retaining block 133 and a stop block 134.

The roller sets 14 are respectively composed of a cross joint 141 and two massaging rollers 145. The cross joint 141 has two mounting shafts 144 and two retaining blocks 143 each formed at the end of mounting shaft 144. The two rollers 145 are provided with a plurality of arcuate grooves 147, and a mounting hole 146. The rollers 145 are mounted on the two mounting shafts 144 that are received respectively in the mounting hole 146 of the rollers 145. The cross joint 141 is provided with a through hole 142 which is provided with two stop slots 148 opposite in location to each other. Each roller set 14 is fastened with one end of the crank axle 13 such that the locating portion 132 of the crank axle 13 is received in the through hole 142 of the cross joint 141.

Referring to FIG. 8 specifically, the transmission apparatus 2 is provided with two slide slots 21, two microswitches 22,23, two chain wheels 24, 25, and a chain 26. The two chain wheels 24 and 25 are actuated by a motor in conjunction with the chain 26, which is located in the groove 112 of the base 11. The slide blocks 111 of the base 11 are capable of moving along the slide slots 21 of the transmission apparatus 2.

The auxiliary device 1 of the present invention is disposed in a back massaging device. In operation, the chain wheels 24 and 25 are driven by motor to actuate the chain 26 so as to cause the auxiliary device 1 of the present invention to move up and down. The up-and-down motion of the auxiliary device 1 is regulated by the microswitches 22 and 23.

The crank axles 13 are capable of turning freely because the stop slots 135 which cooperate with the stop blocks 125 of the movable seat 12. The massaging roller sets 14 are capable of turning freely because to the stop slots 148 of the roller sets 14 which cooperate with the stop blocks 134. As a result, the crank axles 13 and the massaging roller sets 14 with the cooperation of crank axles 13 can massage the curved portions of the back of a person who is using the back massaging device. The compression springs 16 of the auxiliary device 1 of the present invention serve as cushions to prevent the back of the person to make contact with the components of the back massaging device on which the auxiliary device 1 of the present invention is disposed, thereby preventing a back pain which may result from such a contact. In addition, the movable seat 12 is provided with a slot 124 having an arcuate cross section for preventing the vertebrate of the person from making a direct contact with the movable seat 12. The back of the person can be effectively rubbed by the massaging rollers 145 of the roller sets 14 of the auxiliary device 1 of the present invention.

With the chain wheels 24, 25, the chain 26, and the compression springs 16, the movable seat 12, the crank axles 13 and the roller sets 14 of the present invention can move up and down (FIG. 6) as well as to-and-fro in the lateral dimensions (FIG. 4) so as to effectively massage the curved portions of neck, back and waist of the person, thereby bringing about an effective massaging action.

Figure 10:
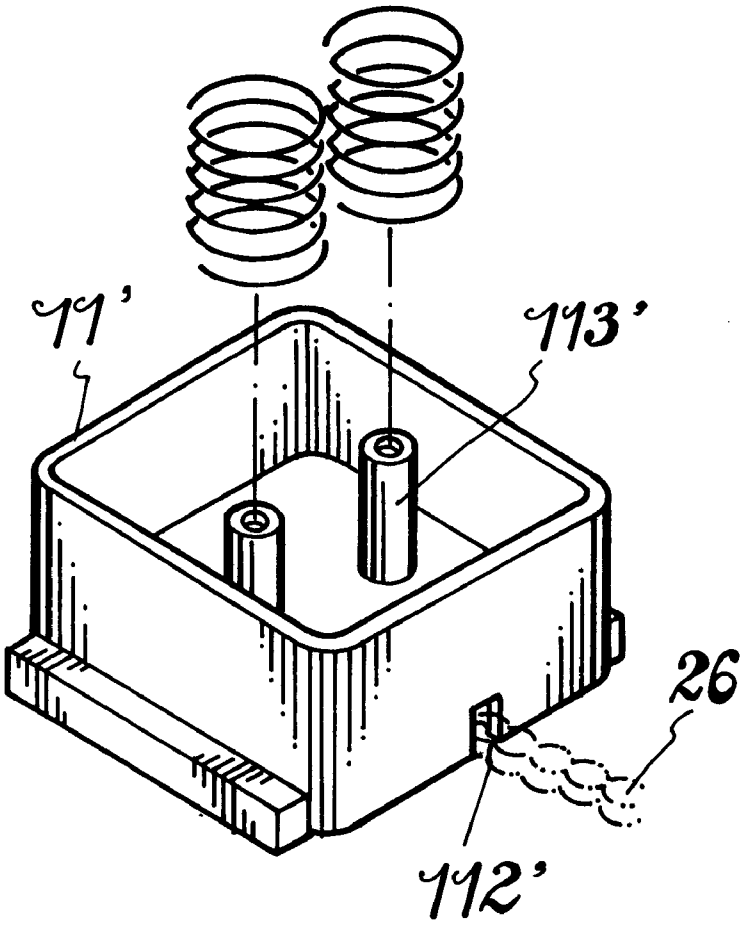
FIG. 10 is similar to FIG. 9, where base equipped with two smaller compression springs in a third embodiment in which compression springs are disengaged from base.
Figure 11:
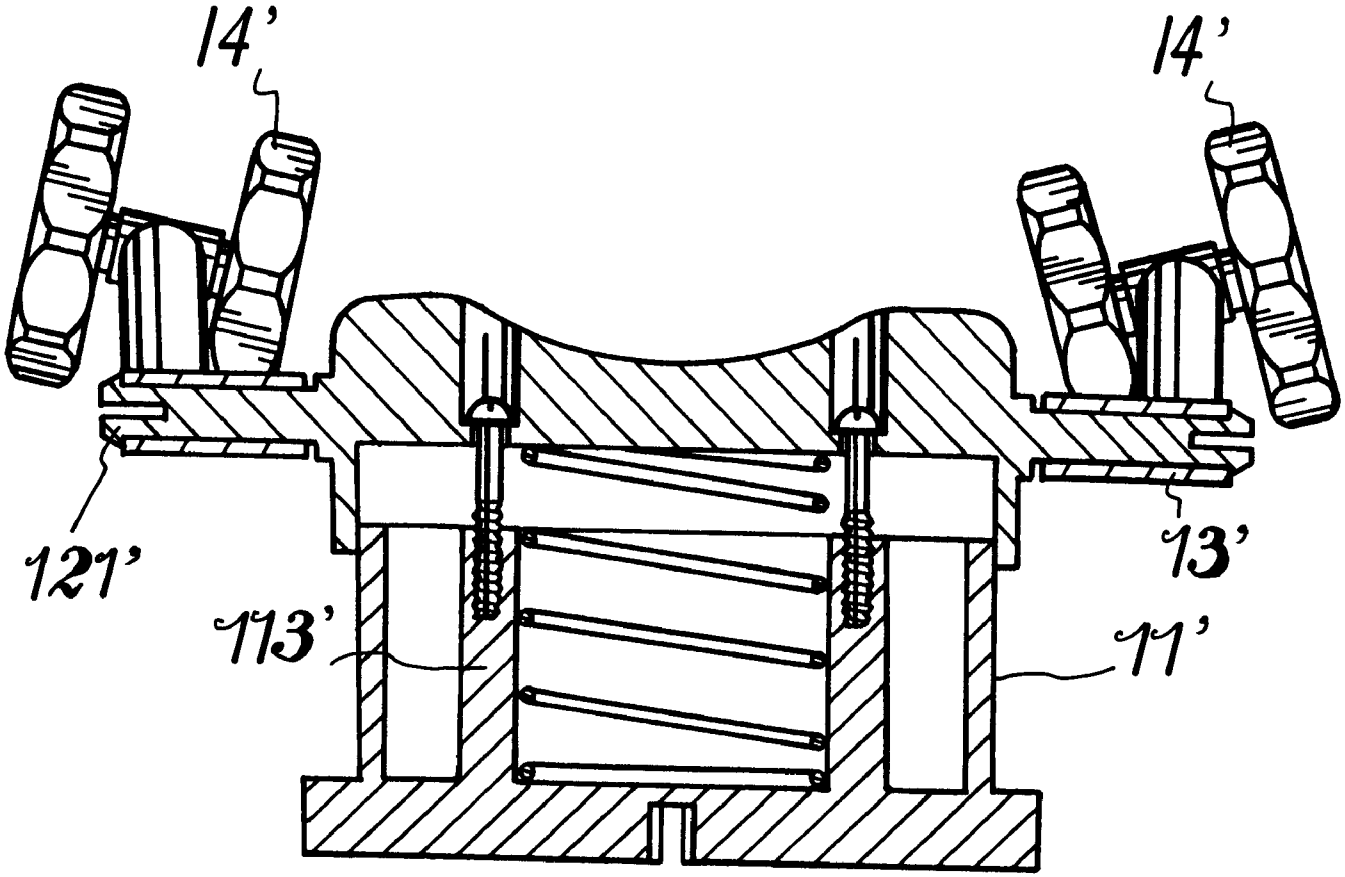
FIG. 11 is a partial cross-sectional view of the assembled auxiliary device in the second embodiment of FIG. 9, where roller sets swinging to-and-fro in the lateral direction.
Figure 12:
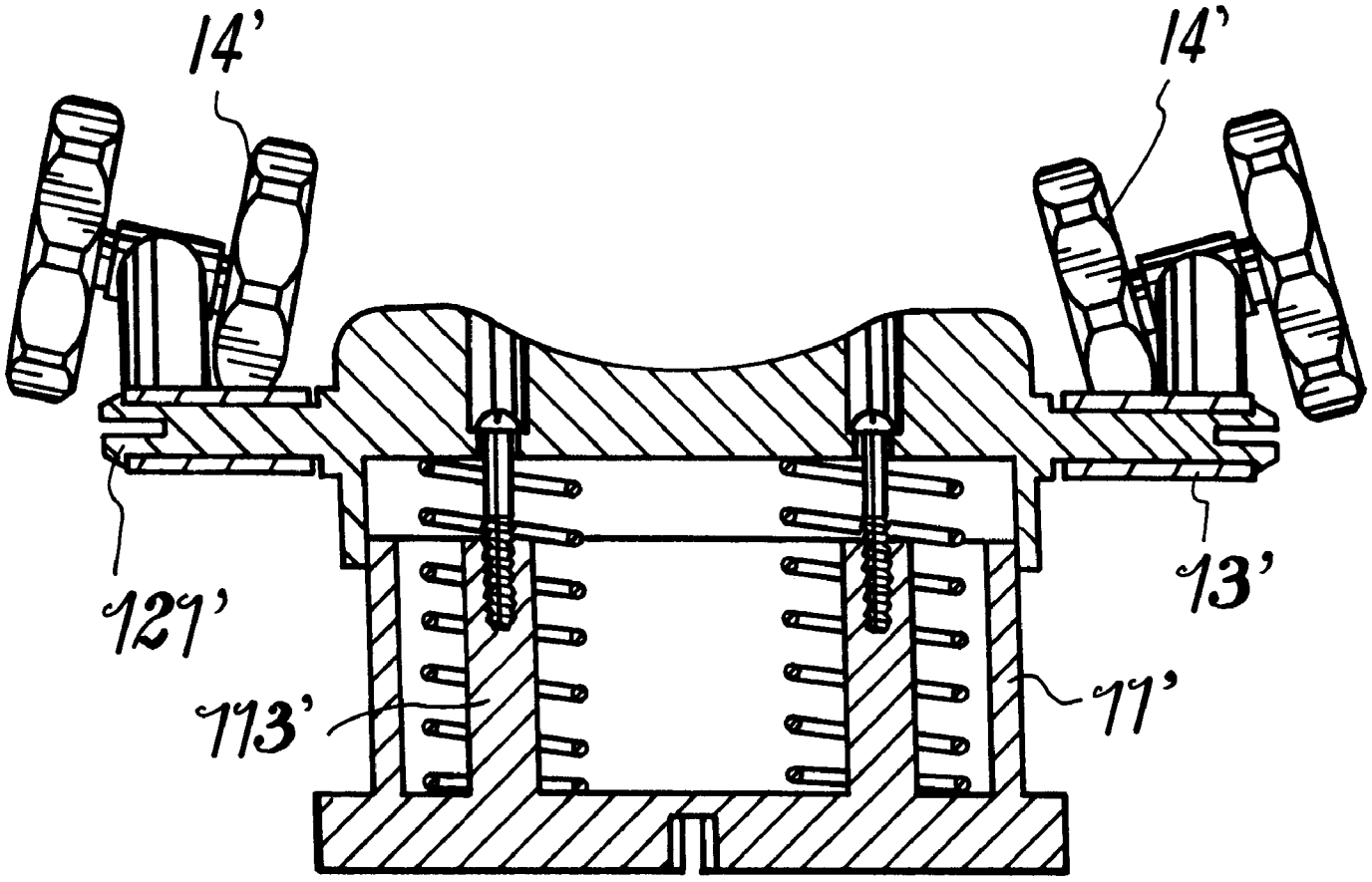
FIG. 12 is similar to FIG. 11, where roller sets swinging to-and-fro in the lateral direction.

As shown in FIGS. 9, 10, 11 and 12, the present invention is modified in such a manner that the base 11' is provided in the underside thereof with a chain-shaped slot 112' in which the chain 26 is located other embodiments in which base 11' is equipped with a large compression spring and a groove is provided in the bottom of base 11' in the second embodiment (FIG. 9), and the base 11' is equipped with two smaller compression springs and a groove 112' is provided in the bottom of base 11' for allowing groove 112' to pass through in the third embodiment (FIG. 10).

Figure 13:
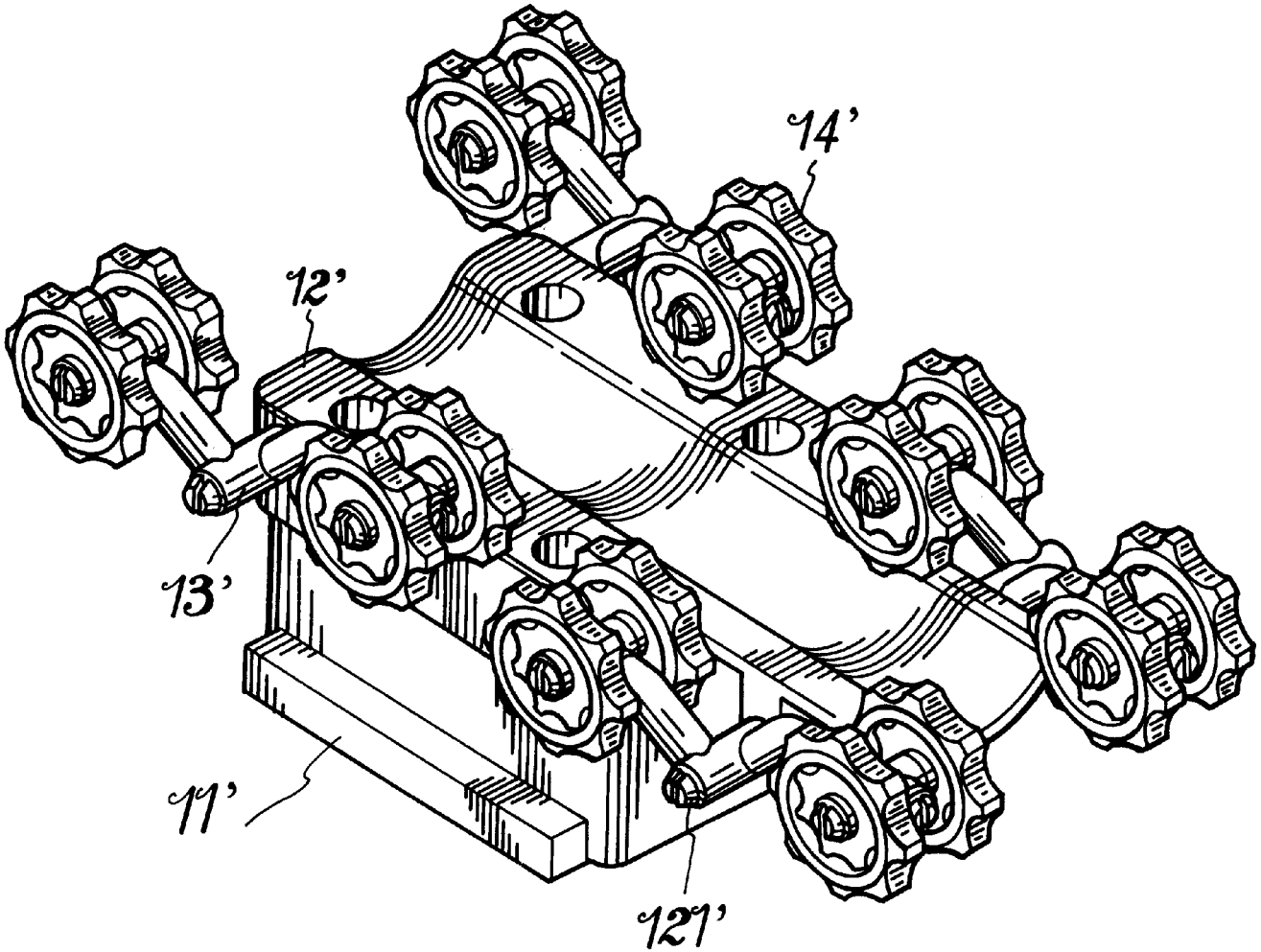
FIG. 13 is a perspective view of a fourth embodiment of the invention, where two locating shafts, four crank axles, and eight roller sets provided.

As shown in FIG. 13, the movable seat 12 of the fourth embodiment is provided with two locating shafts 121' four crank axles 13' and eight roller sets 14'. This can provided a more effective massage on the cured portions of the person.

While the invention herein disclosed has been described by means of specific embodiments, numerous modifications and variations could be made thereto by those skilled in the art without departing from the scope and spirit of the invention set forth in the claims.

What is claimed is:

1. An auxiliary device for used in conjunction with a back massaging means, said device comprising:

a base provided with two slide blocks, a groove, four locating shafts each having a threaded hole and a plurality of compression springs fitted thereover;

a movable seat provided with two locating shafts each having a retaining block and two stop blocks, said movable seat further provided with our round holes each corresponding to one of said locating shafts of said base, and an arcuate slot, said movable seat being fastened with said base such that said locating shafts of said base are received in said round holes of said movable seat, and that said threaded holes of said locating shafts of said base are engaged respectively with a fastening bolt;

a plurality of crank axles each having a through hole which is provided with two opposite stop slots, said crank axles being mounted on said locating shafts of said movable seat such that said locating shafts are received in said through holes of said crank axles, and a location portion formed at either end of said crank axle having a retaining block and a stop block, said crank axles being rotatably mounted on said locating shafts of said movable seat such that said stop slots of said crank axles cooperate with said stop blocks of said movable seat;

a plurality of roller sets each comprising a cross joint and two massaging rollers, said cross joint having two mounting shafts and two retaining blocks each formed at said end of said mounting shaft, said massaging rollers provided with a plurality of arcuate grooves, and a mounting hole, said massaging rollers being mounted on said mounting shafts of said cross joint, said cross joint further having a through hole which is provided with two opposite stop slots, said rollers sets being fastened with one end of said crank axles such that said locating portion of said crank axles is received in said through hole of said cross joint, and that said stop blocks of said crank axles cooperated with said stop slots of said roller sets; and a transmission apparatus provided with two slide slots, two microswitches, two chain wheels, and a chain for actuating said two chain wheels in conjunction with a motor, said chain being located in said groove of said base, whereby said two slide slots receive said two slide blocks of said base.

* * * * *